US007337511B2

(12) United States Patent
Yu et al.

(10) Patent No.: US 7,337,511 B2
(45) Date of Patent: Mar. 4, 2008

(54) BIOLOGICAL HAZARD PROTECTION BODY BAG

(75) Inventors: Hsiu-Chen Yu, Taipei (TW); Chin-Liang Lin, Taipei (TW); Cheng-Ping Chang, Shi Jr (TW)

(73) Assignees: Ching-Liang Yu, Taipei (TW); Institute of Occupation Safety and Health, Taipei (TW); Kang-Ning Junior College of Medical Care & Management, Taipei (TW); Spring Environment Biotech Inc., Taipei (TW)

( * ) Notice: Subject to any disclaimer, the term of this patent is extended or adjusted under 35 U.S.C. 154(b) by 356 days.

(21) Appl. No.: 10/854,629

(22) Filed: May 27, 2004

(65) Prior Publication Data

US 2004/0252918 A1 Dec. 16, 2004

(30) Foreign Application Priority Data

Jun. 2, 2003 (TW) ..... 92210113 U

(51) Int. Cl.
*A61G 1/00* (2006.01)

(52) U.S. Cl. ..... 27/28; 383/100

(58) Field of Classification Search ..... 27/28, 27/11, 35; 383/100, 103, 66, 24, 113, 106, 383/61.2, 63
See application file for complete search history.

(56) References Cited

U.S. PATENT DOCUMENTS 4,164,355 A 8/1979 Eaton et al.
4,418,900 A 12/1983 Ricke
4,617,706 A 10/1986 Waletzko
4,780,940 A * 11/1988 Jay ..... 27/28
4,790,051 A * 12/1988 Knight ..... 27/28
5,388,910 A * 2/1995 Koyanagi ..... 383/100
5,659,933 A * 8/1997 McWilliams ..... 27/28
5,697,132 A 12/1997 DeCarbo et al.
5,715,583 A * 2/1998 Sandoval ..... 27/11
5,829,108 A 11/1998 DeCarbo et al.
5,839,572 A * 11/1998 Yeager ..... 206/204
5,924,181 A 7/1999 Takasugi
6,004,034 A * 12/1999 Salam ..... 383/66
6,408,872 B1 * 6/2002 Skeens et al. ..... 137/512.15

(Continued)

FOREIGN PATENT DOCUMENTS

FR 2546748 * 12/1984

(Continued)

*Primary Examiner*—William L. Miller
(74) *Attorney, Agent, or Firm*—Stevens, Davis, Miller & Mosher, LLP

(57) ABSTRACT

A biological hazard protection body bag comprises an non-transparent outer bag case and a transparent inner bag case, which transparent inner bag case provides a vacuum filtration device formed by a check valve and medical grade filter screen for achieving a vacuum state inside the inner space of the transparent inner bag case by air suction through the check valve of the vacuum filtration device, and the air extracted from the inner space of the transparent inner bag case is completely filtrated by the medical grade filter screen to prevent the pathogen from being extracted from the inner space of the transparent inner bag case to isolate the corpse inside the transparent inner bag case under nearly vacuum state with gastight bag case construction to achieve the purpose of prevent infection or dissemination of pathogen.

20 Claims, 2 Drawing Sheets

U.S. PATENT DOCUMENTS

| | | | | |
|---|---|---|---|---|
| 2003/0145443 | A1* | 8/2003 | Lee | 27/28 |
| 2004/0252918 | A1* | 12/2004 | Yu et al. | 383/100 |
| 2005/0138783 | A1* | 6/2005 | Craig | 27/28 |

FOREIGN PATENT DOCUMENTS

| | | | |
|---|---|---|---|
| GB | 2115690 | * | 9/1983 |
| WO | WO9828974 | * | 7/1998 |

* cited by examiner

BIOLOGICAL HAZARD PROTECTION BODY BAG

BACKGROUND OF THE PRESENT INVENTION

1. Field of the Present Invention

The invention relates to a biological hazard protection body bag, particularly the body bag having double bag case provides a vacuum filtration device comprising a check valve and medical grade filter screen for isolating the body inside the inner bag case where the condition is maintained in nearly vacuum state to eliminate the possibility of pathogen infection or dissemination.

2. Description of Prior Act

Since the infectious diseases shall cause infection through spit droplets or air or through direct contact, the isolation of body or corpse must be made at the first-time when there is a decreased people who died due to infections disease, otherwise, it is apt to pollution on moving worker, moving car, or the air conditioning system of ambulance or cold store system during corpse transportation. Particularly, once the dead body moving car or the air conditioning system of ambulance is polluted the unimaginable dissemination of disease shall be resulted in.

In view of this, the most urgent theme today is how to develop and design a a biological hazard protection body bag to reduce the probability of occurrence of infection during corpse transportation, particularly when the body or the corpse being transported is due to unknown disease, the a biological hazard protection body bag of the invention may isolate the unknown pathogen inside the body bag to prevent the infection and dissemination of the pathogen.

SUMMARY OF THE PRESENT INVENTION

The major purpose of the invention is to provide a biological hazard protection body bag with double bag case structure comprising a non-transparent outer bag case and a transparent inner bag case, wherein the opening of the inner bag case is equipped with multiple gastight strip for sealing the opening, and particularly a vacuum filtration device comprising a check valve and medical grade filter screen is installed on the transparent inner bag case; by way of the transparent inner bag case is tightly sealed with the gastight strips on the bag case opening, and by way of the vacuum filtration device on the inner bag case is quickly connected to an air suction equipment to extract the air from the inner bag case without causing leakage of pathogen from the inner bag case, to make the body be isolated inside the inner bag case where the environment is maintained in nearly vacuum state to eliminate the possibility of pathogen infection or dissemination.

The minor purpose of the invention is to provide a biological hazard protection body bag, when the body is kept inside the transparent inner bag case under nearly vacuum state, an non-transparent outer bag case is used to cover onto the transparent inner bag case, and if necessary, for checking and observation of the body may be made simply by lifting the non-transparent outer bag case without causing pathogen infection or dissemination.

Another purpose of the invention is to provide a biological hazard protection body bag which equipped with a water absorption sheet inside the transparent inner bag case so that a proper amount of antiseptic agent shall be put on the water absorption sheet before the body is put into the bag, and when the inside of the transparent inner bag case is made into nearly vacuum state the high volatile antiseptic agent absorbed by the water absorption sheet shall be gradually evaporated to pervade the space inside the transparent inner bag case to achieve the purpose of body surface sterilization and antisepsis.

Further purpose of the invention is to provide a biological hazard protection body bag which, in addition to the water absorption sheet inside the transparent inner bag case of the corpse bag, also has a drugs bag prepared inside the transparent inner bag case for holding antiseptic agent or pills prepared beforehand. After the body is put in the body bag, and a nearly vacuum state of the inner space of the transparent inner bag case is reached, the drugs inside the drugs bag are crashed by squeeze force from outside of the transparent inner bag case so that the antiseptic agent or pills shall run out of the drugs bag and adhere to the water absorption sheet to achieve the purpose of body surface partial sterilization and antisepsis.

BRIEF DESCRIPTION OF THE DRAWING FIGURES

DETAILED DESCRIPTION OF THE PREFERRED EMBODIMENTS

Figure 1:
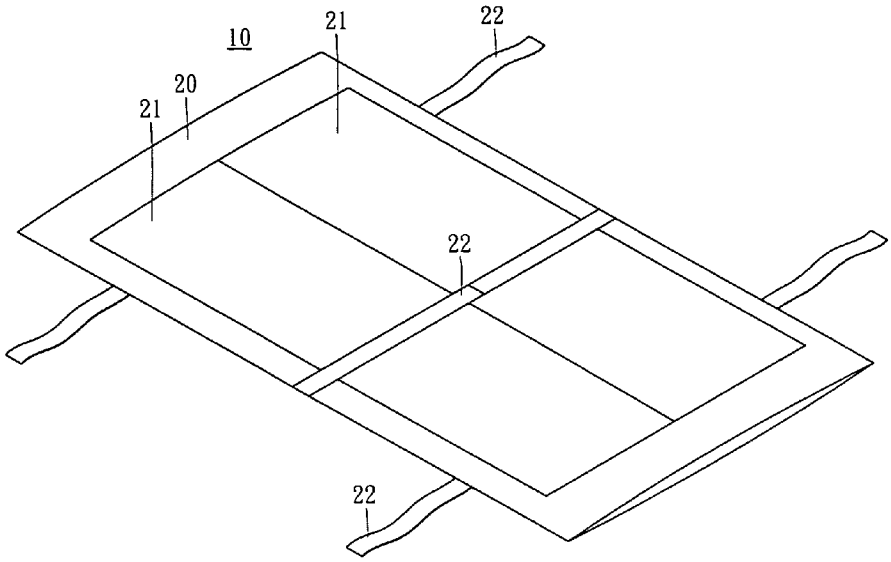
FIG. 1 is the schematic drawing of the biological hazard protection body bag of the invention.
Figure 2:
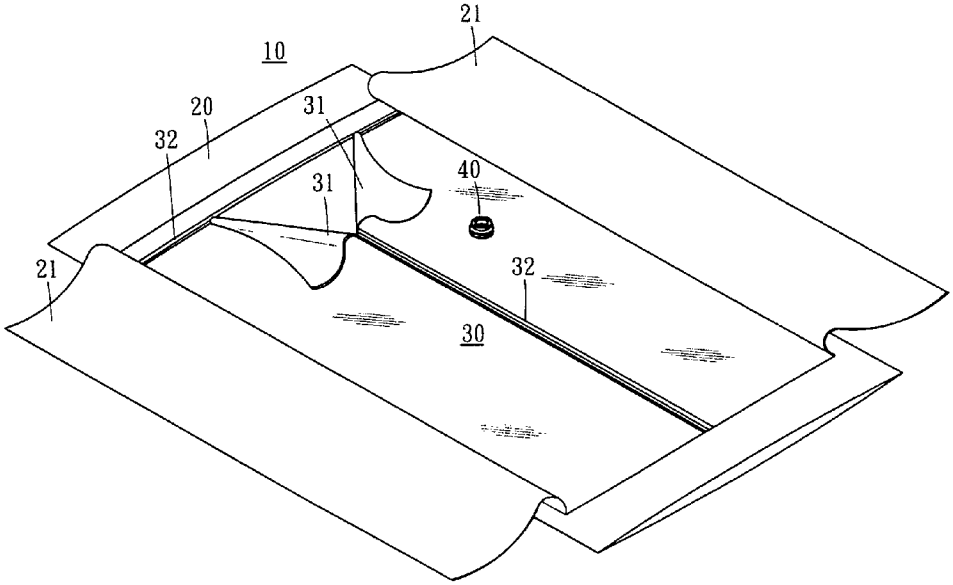
FIG. 2 is the schematic drawing of the biological hazard protection body bag of the invention having double bag case structure, and a vacuum filtration device installed on the transparent inner bag case.

Referring to FIG. 1 and FIG. 2, a biological hazard protection body bag (10) of the invention has double bag case structure comprising an outer bag case (20) made of non-transparent material, and an inner bag care (30) made of transparent material.

Said non-transparent outer bag case (20) has lift-able bag flaps (21). After the bag flaps (21) of the non-transparent outer bag case (20) are lifted, the transparent inner bag case (30) covered by the outer bag case (20) may be exposed to carry out body packing and bag sealing work as well as the air-extraction work to isolate the body or the corpse inside the transparent inner bag case (30)

Figure 4:
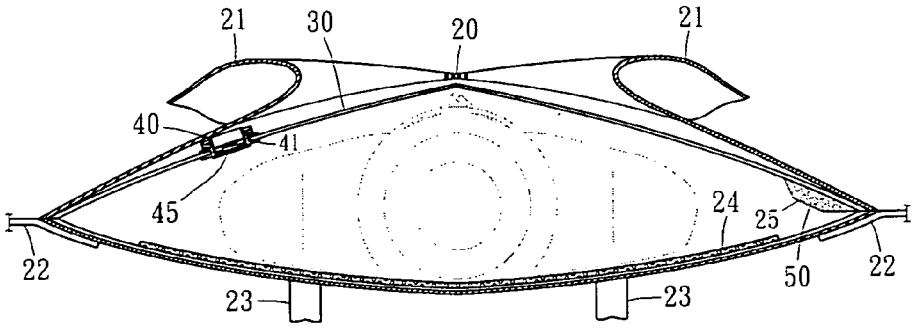
FIG. 4 is the schematic drawing of an example of embodiment of the biological hazard protection body bag of the invention showing different bag structure.

Referring to FIG. 1 and FIG. 4, along the two sides of the non-transparent outer bag case (20), several binding strap (22) are provided for tightening the body or the corpse inside the bag and as a means to conveniently move the body bag (10) during carrying body or corpse. Moreover, by means of the binding strap (22) the biological hazard protection body bag (10) of the invention may also be used as a stretcher to enable a multiple purpose application to the present invention., in case of emergency the injured or disabled patient may lie on the non-transparent bag case (20), and be moved away from the scene for medical treatment. In addition, the non-transparent outer bag case (20) further provides with two back-carrying suspenders (23) on its back side as shown in FIG. 4, when there is short of hands, or special terrain, the biological hazard protection body bag (10) of the invention may be operated and carried by single manpower by way of carrying the biological hazard protection body bag (10) on his/her back.

And, the transparent inner bag case (30) covered with the non-transparent outer bag case (20) is the major design feature of the invention. The inner bag case (30) has a horizontally extending gastight sealing strip (32) adjacent its top edge and lift-able bag flaps (31) equipped with multiple gastight strips (32) for easy and quick sealing the bag opening of the transparent inner bag case (30), and after those multiple gastight strips (32) of the transparent inner bag case (30) are snapped together those multiple gastight strips (32) will never be broken apart even when extreme high pressure is applied on the transparent inner bag case (30).

Referring to FIG. 1 and FIG. 4, a vacuum filtration device (40) comprising a check valve (41) and medical grade filter screen (45) is installed on the transparent bag case (30).

The check valve (41) is installed in such a way which valve body is exposed on both the outer surface and the inner surface of the transparent inner bag case (30) with the outer part of the check valve (41) for being connected to the air suction equipment, and when the air suction equipment applies a suction force during suction operation the valve blade of the check valve (41) moves to allow the air to flow from inner side to outer side of the transparent bag case (30) passing through the air passage of the check valve (41), however, when the air suction equipment stops operation, the suction force disappears, and the valve blade of the check valve (41) immediately returns to its original position to block up the air passage of the check valve (41) that stops the air flow between inside and outside of the transparent inner bag case (30).

Said medical grade filter screen (45) is installed inside the transparent bag case (30) and installed on the open end of valve body of the check valve (41) inside the transparent bag case (30), which has the function able to filtrate off the particle or pathogen with size over 0.1 μm and screen the air passage of the check valve (30). Hence, when the air suction equipment exerts suction force on the check valve (41) to extract the air from the transparent inner bag case (30), the air inside the inner bag case (30) will be completely filtrated by the medical grade filter screen (45) to prevent the small particles or pathogen carried by the air from flowing out from the inner bag case (30), and the small particles or pathogen will adhere to the surface of the medical grade filter screen (45) when they pass through the filter screen (45) to prevent the pathogen to get out of the inner bag case (30).

Figure 3:
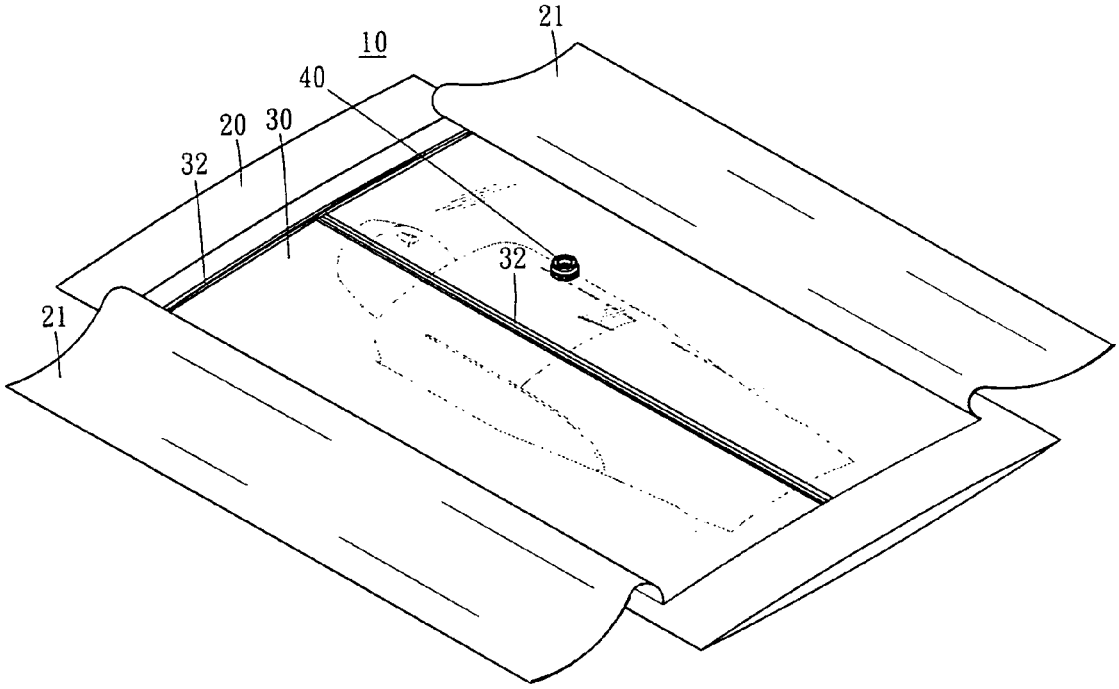
FIG. 3 is the schematic drawing of biological hazard protection body bag of the invention showing a body or a corpse being isolated inside the transparent inner bag case under nearly vacuum state to eliminate the possibility of causing pathogen infection or dissemination.

Then, referring to FIG. 3, after the body or the corpse is packed in the transparent inner bag case (30), the transparent inner bag case (30) is rapidly sealed up by using those quick snap multiple gastight strip (32) to seal the transparent inner bag case (30) to form a gastight sealing, and the bacteria or pathogen carried by the body or the corpse shall be isolated inside the transparent inner bag case (30) by the vacuum filtration device (40) during air suction through the vacuum filtration device (40) that may pack the body or the corpse in a nearly vacuum space inside the transparent inner bag case (30) to effectively eliminate the possibility of pathogen infection or dissemination, then have the transparent inner bag case (30) be covered with the non-transparent bag case (20), and use the binding strap (22) to tight and fix the biological hazard protection body bag (10).

When it is required to examine or observe the body or the corpse, the only thing we need to do is to open the biological hazard protection body bag (10) and lift the non-transparent outer bag case (20), to make direct observation of the isolated body or corpse through the transparent inner bag case (30) without causing infection or dissemination of pathogen.

Further referring to FIG. 4, the biological hazard protection body (10) of the invention may have a water absorption sheet (24) arranged inside the transparent inner bag case (30), and/or have a drugs bag (25) which is provided for antiseptic agent or pills (50) prepared beforehand to be mounted on the bag wall inside the transparent inner bag case (30).

Before the body or the corpse is packed into the transparent inner bag case (30), a proper amount of antiseptic agent is applied on the water absorption sheet (24) inside the transparent inner bag case (30), or after the body or the corpse is packed, the drugs bag (25) may be crashed by squeeze force from outside of the bag case to have the antiseptic agent or pills (50) to adhere to the surface of the water absorption sheet (24). Hence, when the inside space of the transparent inner bag case (30) is sucked to become nearly vacuum state, the antiseptic agent or pills (50) will gradually evaporate to pervade the inner space of the transparent inner bag case (30) to achieve the purpose of having the surface of the body or the corpse be sterilized for surface antisepsis.

In addition, the medical grade filter screen (45) of the vacuum filtration device (40) of the transparent inner bag case (30) may be further equipped with a water absorptive but air permeable material to prevent the medical grade filter screen (45) from being wetted by blood or antiseptic agent to ensure the effectiveness of preventing pathogen infection or dissemination.

Alternatively, in another embodiment, the air discharge and filtration device has no check valve.

The practical applications of the biological hazard protection body bag (10) of the invention includes being applied for handling the body or the corpse due to unknown cause of death whether died outdoors or died before sent to hospital, or died during medical treatment but due to unknown cause that result in the need of legal autopsy to clarify the cause of death. While in these circumstances the corpse can be kept in a nearly vacuum transparent inner bag case (30) with gastight sealing waiting for the required autopsy procedure, and prevent the infection or dissemination of pathogen.

Especially, when the nation meets with grave natural disaster such as the earthquake on September 21 in Taiwan which resulted in heavy losses casualties or when there is burst of war that results in the interruption of electric power supply, and causes failure of carrying out immediate rescue, the body or the corpse may be temporarily stored in the biological hazard protection body bag (10) to reduce the impact on environment and the people still alive, meanwhile by way of keeping the body or the corpse stored in the vacuum state and applied with antiseptic agent or pills (50) inside the transparent inner bag case (30) may effectively decrease the speed of decay of the body or the corpse so that the relatives may clearly identify the dead under safe protection without causing infection of pathogen.

What is claimed is:

1. A biological hazard protection body bag comprising:

a bag case used to pack a corpse inside and to keep the corpse in an isolated space under nearly a vacuum state, wherein the bag case includes a horizontally extending gas tight sealing strip adjacent its upper edge, and two cooperating lift-able bag flaps each including a first horizontally extending gas tight sealing strip on an upper edge thereof for cooperation with the horizontally extending gas tight sealing strip of the bag case, and a second vertically extending gas tight sealing strip on an inner edge thereof for cooperation with the respective second vertically extending gas tight sealing strip of the adjacent flap, and wherein the two flaps are sealed closed via a snap joint created between the adjacent gas tight sealing strips to rapidly seal a bag opening created by the two flaps to form the isolated space inside the bag case; and a vacuum filtration device comprising a check valve and a filter screen installed on the bag case for achieving the nearly vacuum state inside the bag case through the check valve, and causing the air extracted from the inside of the bag case to pass through the filter screen of the vacuum filtration device.

2. The biological hazard protection body bag as defined in claim 1, wherein the filter screen is further equipped with a water proof and air permeable material.

3. The biological hazard protection body bag as defined in claim 2, wherein the bag case is further equipped with a water absorption sheet inside.

4. The biological hazard protection body bag as defined in claim 2, wherein the bag case is further equipped with a drug bag prepared for an antiseptic agent or pills.

5. The biological hazard protection body bag as defined in claim 3, wherein the bag case is further equipped with a drug bag prepared for an antiseptic agent or pills.

6. The biological hazard protection body bag as defined in claim 1, wherein the bag case is further equipped with a water absorption sheet inside.

7. The biological hazard protection body bag as defined in claim 6, wherein the bag case is further equipped with a drug bag prepared for an antiseptic agent or pills.

8. The biological hazard protection body bag as defined in claim 1, wherein the bag case is further equipped with a drug bag prepared for an antiseptic agent or pills.

9. The biological hazard protection body bag as defined in claim 1, wherein the bag case is made of transparent material.

10. The biological hazard protection body bag as defined in claim 1, wherein a non-transparent lift-able bag case is formed outside and in at least partial surrounding contact with the bag case to make a double bag case structure for the biological hazard protection body bag.

11. The biological hazard protection body bag as defined in claim 10, wherein both sides of the non-transparent bag case are equipped with binding straps.

12. The biological hazard protection body bag as defined in claim 11, wherein the filter screen is further equipped with a water proof and air permeable material.

13. The biological hazard protection body bag as defined in claim 12, wherein the bag case is further equipped with a water absorption sheet inside.

14. The biological hazard protection body bag as defined in claim 13, wherein the bag case is further equipped with a drug bag prepared for an antiseptic agent or pills.

15. The biological hazard protection body bag as defined in claim 10, wherein the back side of the non-transparent bag case is equipped with back-carrying suspenders.

16. The biological hazard protection body bag as defined in claim 15, wherein the filter screen is further equipped with a water proof and air permeable material.

17. The biological hazard protection body bag as defined in claim 16, wherein the bag case is further equipped with a drug bag prepared for an antiseptic agent or pills.

18. The biological hazard protection body bag as defined in claim 10, wherein the filter screen is further equipped with a water proof and air permeable material.

19. The biological hazard protection body bag as defined in claim 10, wherein the bag case is further equipped with a water absorption sheet inside.

20. The biological hazard protection body bag as defined in claim 10, wherein the bag case is further equipped with a drug bag prepared for an antiseptic agent or pills.

* * * * *